US008584603B2

(12) United States Patent
Villiger

(10) Patent No.: US 8,584,603 B2
(45) Date of Patent: Nov. 19, 2013

(54) DEVICE FOR RECEIVING BANKNOTES, SECURITY SYSTEM HAVING SUCH A DEVICE, AND CORRESPONDING METHOD

(76) Inventor: Peter Villiger, Beinwil (CH)

( * ) Notice: Subject to any disclaimer, the term of this patent is extended or adjusted under 35 U.S.C. 154(b) by 186 days.

(21) Appl. No.: 13/101,392

(22) Filed: May 5, 2011

(65) Prior Publication Data

US 2011/0271879 A1 Nov. 10, 2011

(30) Foreign Application Priority Data

May 6, 2010 (CH) ..... 00694/10

(51) Int. Cl.
*E05G 1/00* (2006.01)

(52) U.S. Cl.
USPC ..... 109/25; 109/22; 109/47; 109/50; 232/15; 232/1 D

(58) Field of Classification Search
USPC ..... 109/22, 23, 24.1, 25, 29–32, 45–47, 109/50–52; 232/15, 16, 1 D
See application file for complete search history.

(56) References Cited

U.S. PATENT DOCUMENTS

| | | | | |
|---|---|---|---|---|
| 3,677,461 | A * | 7/1972 | Nitschneider et al. | 232/15 |
| 5,161,736 | A * | 11/1992 | Roccoberton et al. | 232/15 |
| 5,400,914 | A | 3/1995 | Lin | |
| 5,533,605 | A * | 7/1996 | Mays et al. | 194/206 |
| 5,850,966 | A | 12/1998 | Siler et al. | |
| 6,579,165 | B2 * | 6/2003 | Kuhlin et al. | 453/3 |
| D479,683 | S * | 9/2003 | Turvey et al. | D8/373 |
| 6,719,121 | B2 * | 4/2004 | Alexander et al. | 194/350 |
| 7,059,599 | B2 * | 6/2006 | Lewis | 271/213 |
| 7,100,520 | B2 * | 9/2006 | Abe et al. | 109/25 |
| 7,819,306 | B2 * | 10/2010 | Williams et al. | 232/1 D |
| 7,909,198 | B2 * | 3/2011 | Lewis | 220/345.2 |
| 2006/0071412 | A1 * | 4/2006 | Lewis | 271/213 |
| 2008/0296366 | A1 * | 12/2008 | Schoeffler et al. | 235/379 |
| 2010/0193582 | A1 * | 8/2010 | Johnson | 232/1 D |

FOREIGN PATENT DOCUMENTS

| | | | |
|---|---|---|---|
| EP | 1 369 826 | A1 | 12/2003 |
| GB | 2 269 205 | A | 2/1994 |
| WO | WO 02/19289 | A2 | 3/2002 |

OTHER PUBLICATIONS

European Search Report for European Patent Application No. EP 11 16 3993, mailed Jul. 21, 2011.

* cited by examiner

*Primary Examiner* — Suzanne Barrett
(74) *Attorney, Agent, or Firm* — McCarter & English, LLP

(57) ABSTRACT

A device for receiving banknotes with a frame which provides a banknote opening, and has a banknote bag connected to the frame using a bag opening so that banknotes are introducible through the banknote opening and the bag opening into the banknote bag. The device has a sliding bolt. The frame has an upper frame and a lower frame being separable from each other, and the banknote opening extends through both frames when the upper frame is connected to the lower frame. The frame has a guide for inserting the sliding bolt which is designed so that in the inserted state, the sliding bolt is locked with the frame and completely covers the banknote opening of the two frames.

21 Claims, 10 Drawing Sheets

DEVICE FOR RECEIVING BANKNOTES, SECURITY SYSTEM HAVING SUCH A DEVICE, AND CORRESPONDING METHOD

CROSS-REFERENCE TO RELATED APPLICATIONS

This application claims priority under 35 U.S.C. §§119(a-d) to Swiss Patent Application CH 00694/10, filed on May 6, 2010, the contents of which are hereby incorporated by reference in its entirety as part of the present disclosure.

FIELD OF THE INVENTION

The invention relates to a device for receiving banknotes, a security system having a device for receiving banknotes, and a method for preparing a device which is designed to receive banknotes.

BACKGROUND OF THE INVENTION

There are numerous systems for transporting objects which require protection, for example, valuables such as coins and banknotes, valuable papers, other valuable objects such as precious metals and precious stones, and documents to be kept secret.

The secure handling of large quantities of banknotes requires particular attention. Special strong boxes are increasingly being used, which are designed for the purpose of receiving individual banknotes or bundles of banknotes. A known safe 200 is shown in a schematic view in FIG. 1, which comprises a banknote intake 202. Individual banknotes 1 may be drawn into the safe 200 through the banknote intake 202, checked and detected with respect to value as they are drawn in, for example. In FIG. 1, a situation is shown in which a banknote 1 is currently being drawn in. The safe 200 may have a display 203 to display, for example, processing-related information, such as, the total value of drawn-in banknotes 1. One or more cash boxes 201 may be seated in the interior of the safe 200. In the example shown in FIG. 1, one cash box 201 may be seen in the interior of the safe 200. The banknotes 1 arrive in the cash box 201 after being drawn in from the top. From time to time, or if the cash box 201 is full, a money transporter may unlock and open a door 204 of the safe 200 to remove the entire cash box 201 together with the banknotes 1 contained therein.

A schematic view of a known cash box 201 is shown in FIG. 2. A handling mechanism 205 is typically provided in the upper area of the cash box 201, which transfers banknotes 1 that are received from above (as schematically indicated by the arrow P1), into the interior of a banknote bag 130. The banknote bag 130 hangs on a frame 120. Banknotes 1 reach the banknote bag 130 through a banknote opening 121 provided in the frame.

The safe 200, together with the cash box 201 and the banknote bag 130 and frame 120, forms a security system, which is used to protect the owners or possessors of the banknotes 1 from misuse or from pilferage of the banknotes 1. For this purpose, for example, the banknotes 1 may be checked and counted as they are drawn in. The count may be stored or transmitted to a server via a communication connection, for example. The cash box 201 may contain a pressure system having a gas cartridge, for example, to discharge a liquid (e.g., ink), if the safe 200 and/or the cash box 201 are manipulated. This system thus damages, marks, or destroys the banknotes 1 that are present in the cash box 201 using the previously mentioned liquid.

Overall, a closed loop may thus be implemented, in which all individual elements or components and all substeps are monitored and/or secured.

In previous solutions, rigid and liquid-tight plastic bags are used as the banknote bags 130. For the previously mentioned liquid to be able to reach the banknotes 1, a complex melting device must be used, which first melts the plastic bag before pressurized liquid can reach the banknotes 1. This approach is complex and susceptible to failure. In addition, it allows certain forms of manipulations, which could allow unauthorized persons to protect at least a part of the banknotes 1 from devaluation by the liquid.

It is a further disadvantage of prior solutions that the plastic bag together with the frame 120 form a complex functional unit, which is costly and susceptible to failure. In addition, this functional unit is designed so that the plastic bag must be destroyed to remove the banknotes 1 and the entire functional unit, together with the frame, must be discarded.

SUMMARY OF THE INVENTION

It is therefore the object of the invention to refine the security system of the type mentioned at the beginning and to improve its security. Simultaneously, the cost of the security system and/or individual components is to be reduced if possible.

In one aspect, a device for receiving at least one banknote comprises a frame including a banknote opening, a banknote bag connected to the frame by a bag opening such that the at least one banknote is introducible into the banknote bag through the banknote opening and the bag opening, and a stable sliding bolt. In some embodiments, the frame comprises an upper frame and a lower frame separable from each other, with the banknote opening extending through the upper frame and the lower frame when the upper frame is connected to the lower frame. The frame includes a guide for inserting the sliding bolt, with the guide being configured such that in the inserted state, the sliding bolt is locked to the frame and completely covers the banknote opening of the upper and lower frames.

In another aspect, a security system comprises a safe or a cash box and at least one device for receiving at least one banknote comprising a frame including a banknote opening, a banknote bag connected to the frame by a bag opening such that the at least one banknote is introducible into the banknote bag through the banknote opening and the bag opening, and a stable sliding bolt. In some embodiments, the frame comprises an upper frame and a lower frame separable from each other, with the banknote opening extending through the upper frame and the lower frame when the upper frame is connected to the lower frame. The frame includes a guide for inserting the sliding bolt, with the guide being configured such that in the inserted state, the sliding bolt is locked to the frame and completely covers the banknote opening of the upper and lower frames.

These and other advantages and features of the invention will become more readily apparent from the following description of embodiments of the invention, which are to be understood not to be limiting and which will be explained in detail below with reference to the drawings.

DETAILED DESCRIPTION OF EMBODIMENTS OF THE INVENTION

In the present disclosure, location and direction specifications are used hereafter in order to be able to better describe the invention. These specifications relate to a respective situation and therefore are not to be understood as a restriction. In order to be able to delimit the location and direction specifications better, a reference is sometimes also made to the safe 200 or the cash box 201, in which a reference is made to a device-side element or door-side element, for example.

In one aspect, the invention is described on the basis of FIGS. 1A-8B. A device 100 is developed for receiving banknotes 1 and handling them securely.

Figure 1:
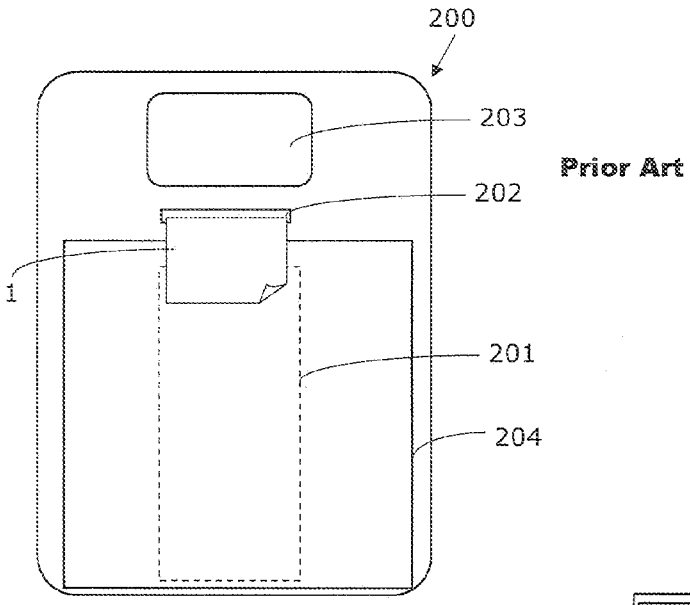
FIG. 1 is a schematic view of a safe having cash box.
Figure 2:
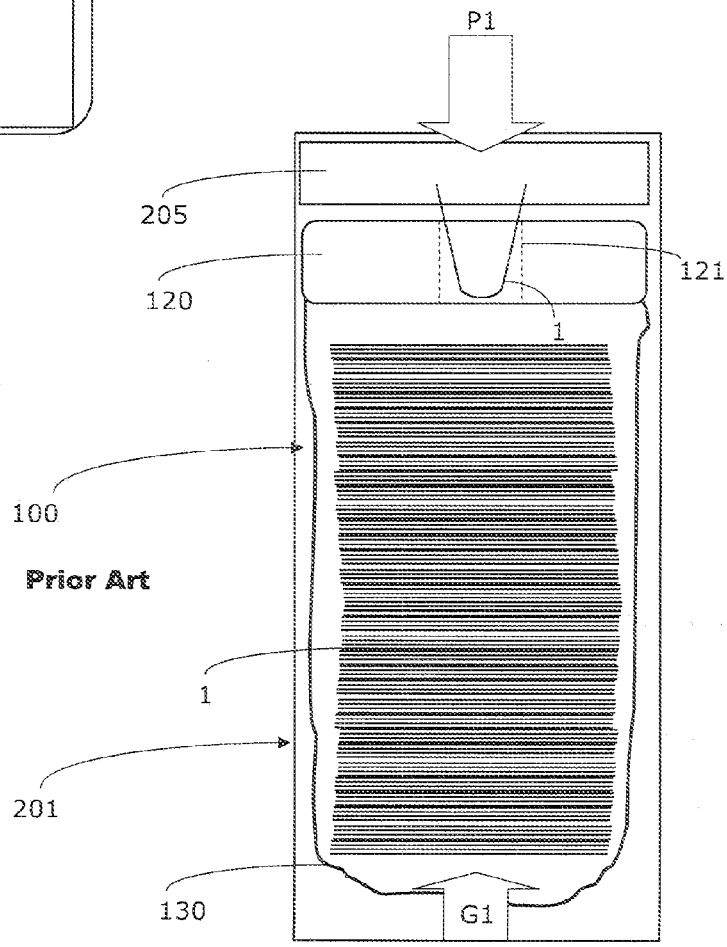
FIG. 2 is a schematic view of a cash box having frame and banknote bag.

The device 100 comprises a frame 120, which, as shown in FIG. 2, includes a banknote opening 121. A banknote bag 130 is connected, using the bag opening 132, to the frame 120 in such a way that banknotes 1 can be introduced into the banknote bag 130 through the banknote opening 121 and the bag opening 132. An illustration is shown in FIG. 2, in which a single banknote 1 has been pressed through the banknote opening 121 from above. The pressing through can be performed using a plunger body in a known manner, for example, which is not shown here. The plunger body can be provided as an element of a handling mechanism 205 on the cash box 201 or on the safe 200. The plunger body presses a banknote 1, which was previously conveyed into a position lying flat above the banknote opening 121 of the frame 120, centrally downward. The banknote 1 is thus folded together centrally and can be pushed downward. As soon as the banknote 1 passes through the area of the banknote opening 121, it unfolds again and lies flat on a stack of banknotes 1, which is schematically shown in FIG. 2.

The frame 120, which holds the banknote bag 130 open and fixedly clamps it, simultaneously provides the banknote opening 121. In addition, the frame 120 can be used as a mechanical interface, which is designed for the purpose of inserting the device 100 into a cash box 201 or into a safe 200. Interaction with the transfer mechanism (e.g., with the previously-mentioned plunger body) must be ensured. The transfer mechanism is referred to here as the handling mechanism 205.

In at least one embodiment, a frame 120 is used that comprises an upper frame 123 and a lower frame 124. The lower frame 124, which is shown in greater detail in FIGS. 3A-3C, can also be referred to as a collar part, since it fixes the banknote bag 130 and holds it open, as shown in FIG. 4C.

The frame 120 is composed of the upper and lower frames 123, 124 in such a way that the banknote opening 121 extends through both frames 123, 124 when the upper frame 123 is connected to the lower frame 124. The upper frame 123 and the lower frame 124 are implemented so that they are separable from one another. Both frames 123, 124 may engage each other so that they can only be separated by the use of a special tool. When the two frames 123, 124 are connected to each other they form the frame 120.

Figure 5A:
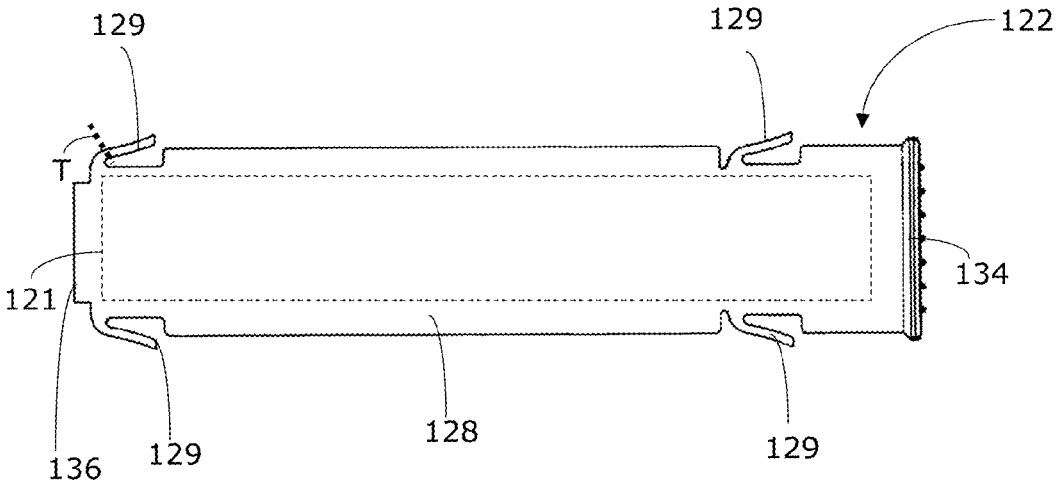
FIG. 5A is a top view of a sliding bolt.
Figure 5B:
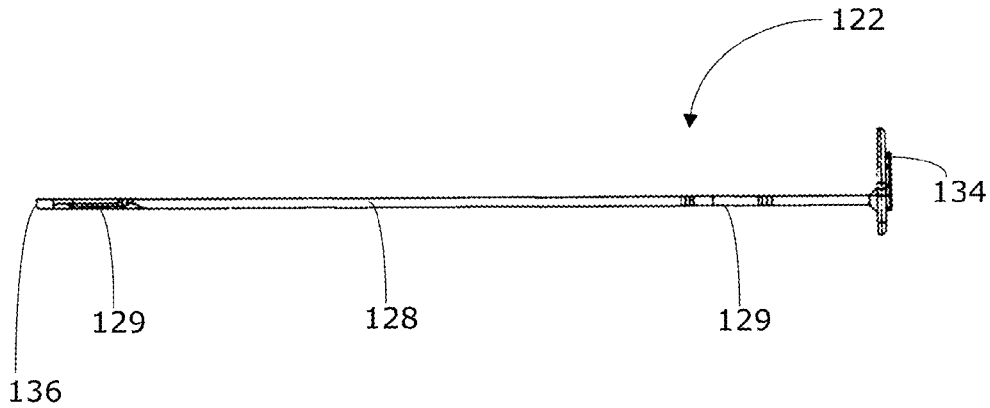
FIG. 5B is a side view of the sliding bolt of FIG. 5A.

In one aspect, a sliding bolt 122, which is stable per se, is used and has at least two main functions. An exemplary sliding bolt 122 is shown in FIGS. 5A and 5B. As for the first function, the frame 120 comprises a guide 126 for inserting the sliding bolt 122, which is designed so that, when in the inserted state, the sliding bolt 122 is locked (fixedly connected) to the frame 120. As for the second function, when in the inserted and locked state, the sliding bolt 122 completely covers the banknote opening 121 of the two frames 123, 124. A side view of this state, which is referred to as the secured state, is shown in FIG. 8B. When in then secured state, the banknote bag 130 is no longer accessible, since it is fixedly connected to the lower frame 124 and because the banknote opening 121 is fixedly closed and locked by the sliding bolt 122.

The sliding bolt 122 may have an additional third function. This additional function may be used in multiple embodiments. If the device 100 is seated in a cash box 201 or a safe 200, the device 100 is connected via the frame 120 to the money transfer system or the money transfer mechanism (referred to as the handling mechanism 205) of the cash box 201 or the safe 200. In order to prevent the device 100 from being removed in an unauthorized manner, which would allow manipulation, removal of the device 100 is only possible if the sliding bolt 122 is in the inserted and locked state, i.e., is in the secured state. The device 100 may be decoupled or unlocked from the cash box 201 or from the safe 200, or the device 100 may be decoupled or unlocked in a further step from the cash box 201 or from the safe 200, only when the sliding bolt 122 reaches the secured state.

Alternatively, the sliding bolt 122 may also be designed so that in the secured state, it allows or releases unlocking or decoupling of the device 100. The actual unlocking or decoupling can be performed, for example, in a further step via a key, a contact switch, or a similar auxiliary element. This additional alternative design may be used in multiple embodiments.

The sliding bolt 122 can optionally be provided with a machine-readable code (e.g., a barcode), in order to support a security sequence or protocol.

Further aspects and details of embodiments of the invention are described hereafter, which can be applied as needed individually, jointly, or in various subcombinations.

Figure 3A:
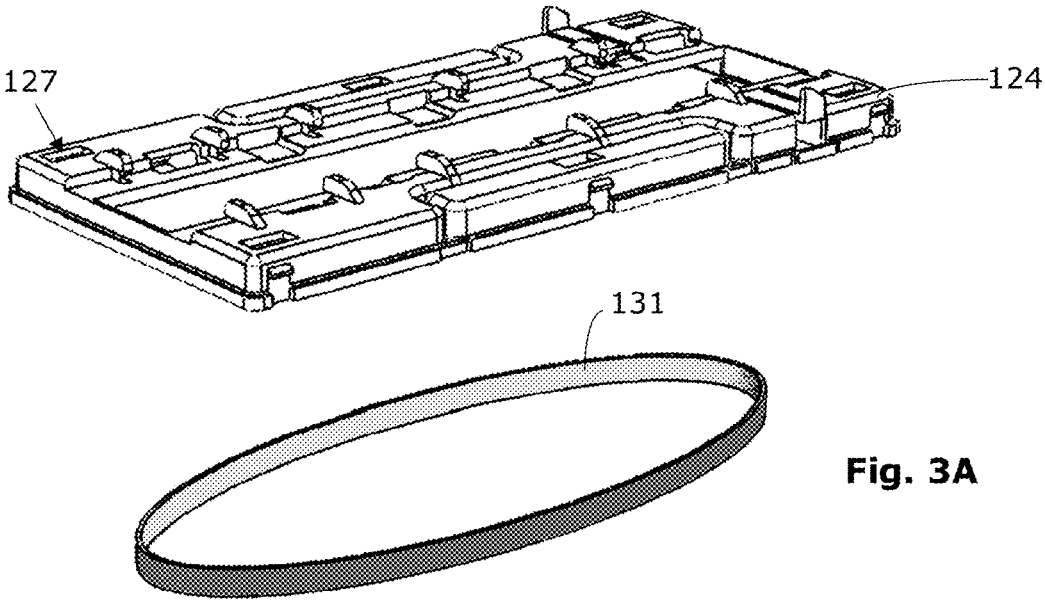
FIG. 3A is an exploded view of a lower frame and a rubber ring.

FIG. 3A shows an exploded view of the lower frame 124. A rubber ring 131, shown below the frame 124, may be fastened on the frame 124 as follows. A loop of the rubber ring 131 can be inserted or clamped on a first long side in a recess 134 on the top side of the lower frame 124. From there, a section of the rubber ring 131 is guided below the frame 124 transversely to the banknote opening 121 to the opposite long side.

Figure 3B:
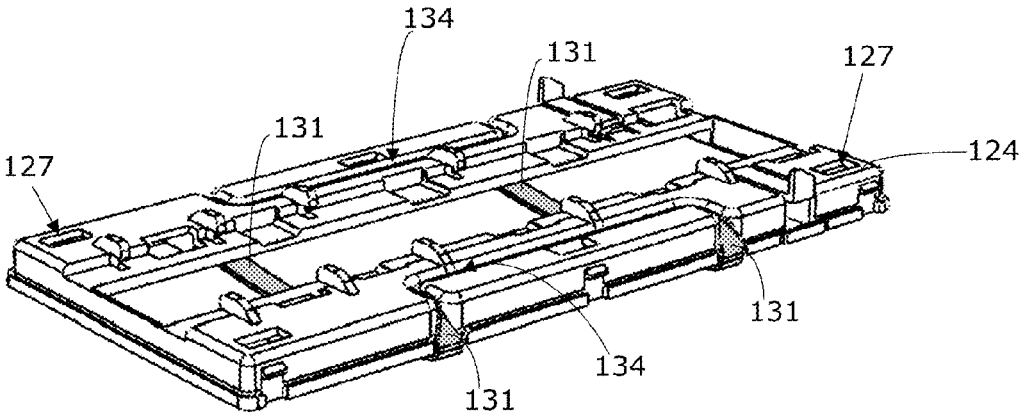
FIG. 3B is a perspective view of the lower frame with an installed rubber ring.
Figure 3C:
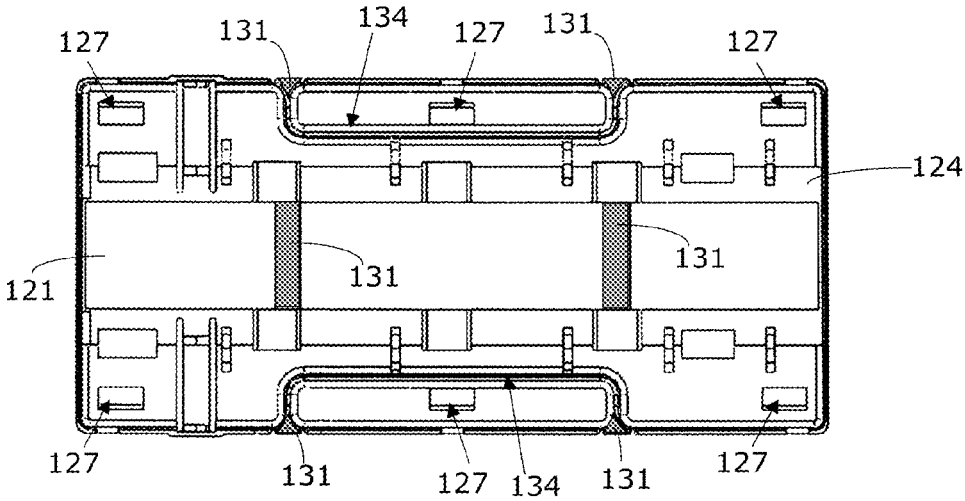
FIG. 3C is a top view of the lower frame with an installed rubber ring of FIG. 3B.

Another section of the rubber ring 131 is also guided, similarly thereto, below the frame 124 transversely to the banknote opening 121 to the opposite long side. The two sections of the rubber ring 131, therefore, run on the bottom side of the frame 124 transversely over the banknote opening 121, as shown in FIGS. 3B and 3C. The remaining end (or the remaining loop) of the rubber ring 131 is in turn inserted or clamped into a recess 134 on the top side of the lower frame 124 on the opposite long side of the frame 124. The rubber ring 131 is thus fixedly connected to the lower frame 124.

The rubber ring 131 has the following function. In previous systems, a large spring or a spring-loaded follower plate is used in a cash box 201 to constantly press the banknote bag 130 upward in the direction of the frame 120. The spring or follower plate applies a counter force G1 (see FIG. 2), which must be overcome when introducing banknotes 1. The rubber ring 131 completely replaces the spring or follower plate, or in some instances supplements the spring or follower plate, as needed. The rubber ring 131 is stretched further with each banknote 1 that reaches the banknote bag 130 from above through the banknote opening 121. The result is a very reliable, simple and cost-effective counter force G1 that is not very susceptible to failure.

Other fasteners may also be used for fastening a rubber ring 131. It is also possible to provide two rubber rings, for example, instead of only one rubber ring 131. Both a closed rubber ring 131, as shown in FIG. 3A, and also one or more rubber strips can be used. Such a rubber strip can have eyes on each end, for example, so that it can be suspended or clamped on the long sides of the lower frame 124. The function or mode of operation is the same in this instance.

FIGS. 3A-3C show that the lower frame has a row of tabs and/or clamping areas 127. These tabs and/or clamping areas 127 may be designed so that the upper frame 123 can be placed on the lower frame 124 and fixedly connected thereto. Lugs or hooks of the upper frame 123 may catch in the clamping areas 127 of the lower frame 124 and/or vice versa.

Figure 4A:
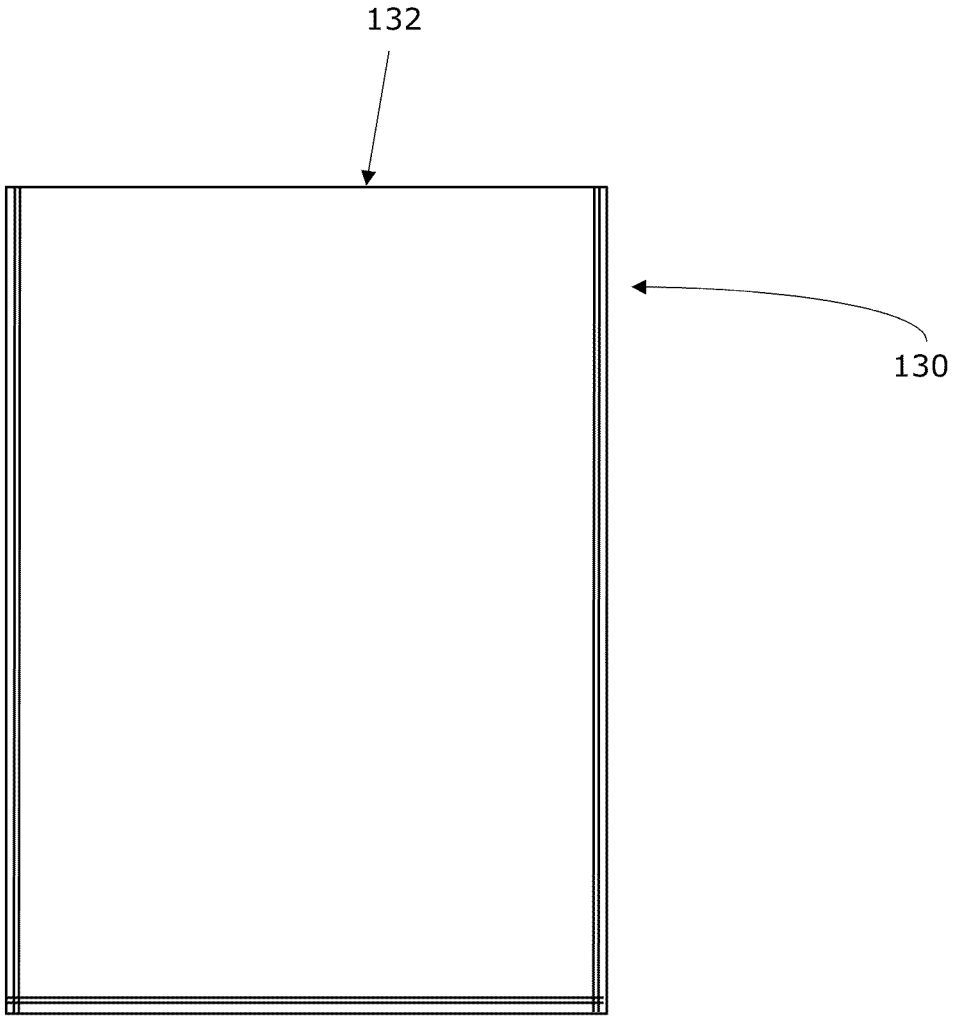
FIG. 4A is a schematic side view of a banknote bag.

FIG. 4A is a side view of a banknote bag 130. The bag opening 132 is located on the top of the banknote bag 130. The bag 130 is closed on the bottom and on the sides. Welded edges (in the case of plastic bags or fabric bags made of thermoplastic fabric), seams, or other means can be used here. That is, the banknote bag 130 is closed on three sides and is open on only one side. The welded edges are indicated by double lines in FIG. 4A.

Figure 4B:
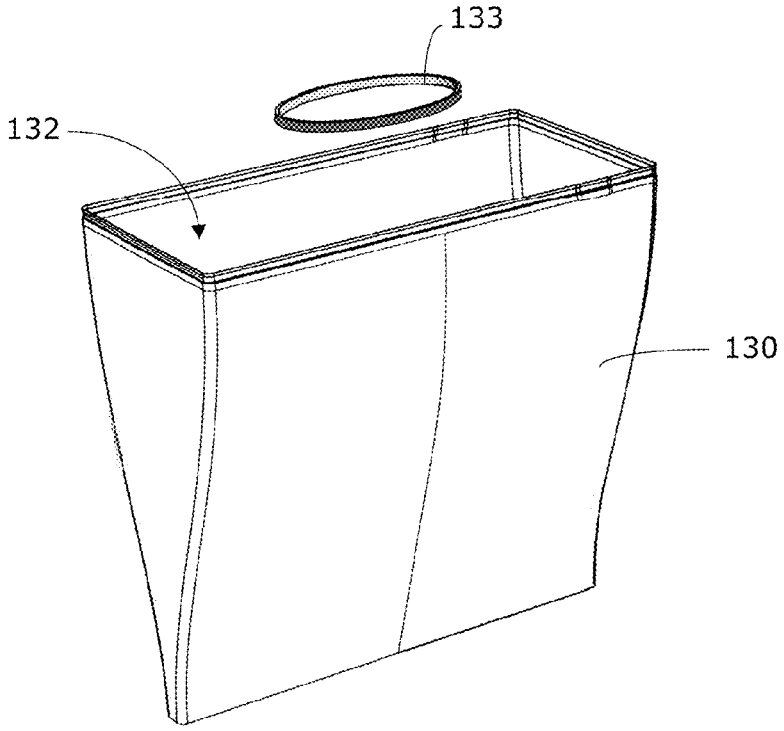
FIG. 4B is an exploded view of the banknote bag of FIG. 4A and a further rubber ring.
Figure 4C:
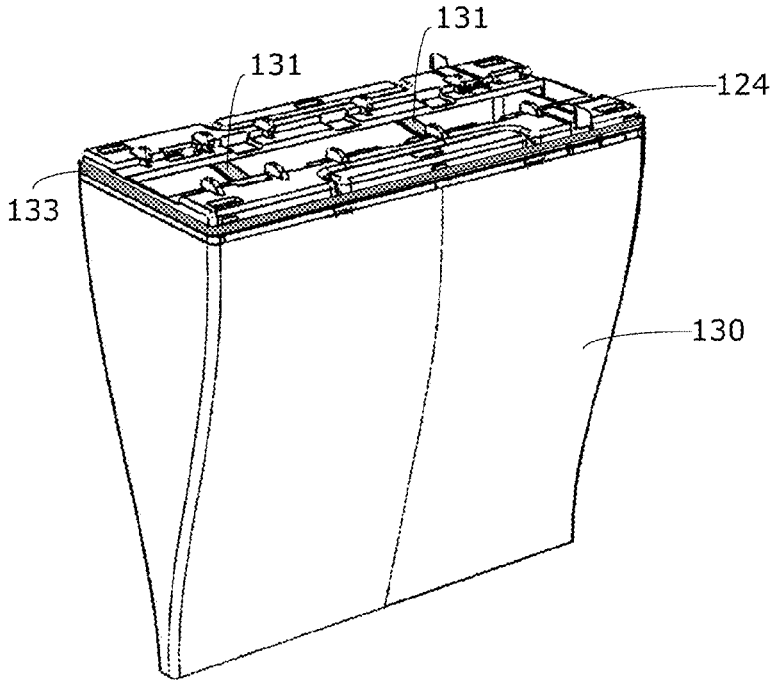
FIG. 4C is a perspective view of the lower frame of FIG. 3C fastened onto the banknote bag of FIG. 4B using the rubber ring.

FIG. 4B is an exploded view of an exemplary banknote bag 130, with the bag opening 132 adjusting to the rectangular shape of the lower frame 124. An optional rubber ring 133 is shown above the banknote bag 130. The rubber ring 133 can, as shown in FIG. 4C, be used for the purpose of connecting the banknote bag 130 to the lower frame 124. For this purpose, the opening 132 of the banknote bag 130 can be laid around the lower frame 124. The rubber ring 133 is then pulled over it. The use of the rubber ring 133 is but one means of connecting the bag 130 to the lower frame 124. Other means may be used. For example, the banknote bag 130 can alternatively be clamped or stretched on the lower frame 124. The banknote bag 130 may be clamped or stretched on the lower frame 124 and secured using a rubber ring 133.

In one instance, the banknote bag 130 has eyes or hooks on the upper edge for better hooking on the frame 124. The banknote bag 130 may additionally, or alternatively, contain an elastic band or a rubber strip, which may be situated in the area of the bag opening 132. In these cases, the rubber ring 133 can be dispensed with.

The various functions of the sliding bolt 122 have been previously described. FIGS. 5A-5B show an exemplary sliding bolt 122. The sliding bolt 122 has a slide plate 128, which is provided with catch elements or (barbed) hooks 129. The slide plate 128 has a planar extension, which is selected so that the banknote opening 121 of the frame 120 (comprising the two subframes 123, 124) is covered when the sliding bolt 122 is in the inserted and locked state, i.e., in the secured state. The location and dimension of the banknote opening 121 is schematically indicated by a dashed rectangle in FIG. 5A. It may be seen here that the slide plate 128 has a planar extension which is somewhat larger than the planar extension of the banknote opening 121.

The sliding bolt 122 may be provided with a handle area, a tab, or similar handling means 134, in order to be able to grasp the sliding bolt 122, insert it, and transfer it into the secured state.

The sliding bolt 122 may be provided with catch elements or (barbed) hooks 129, which grip or catch the frame 120 so that the sliding bolt 122 can only be removed by destroying the sliding bolt 122 or the catch elements or hooks 129. In the illustrated embodiment, the catch elements or hooks 129 of the sliding bolt 122 are somewhat flexible. When the sliding bolt 122 is inserted into the upper frame 123, the catch elements 129 are deformed inwardly toward the side plate 128 by the walls of the upper frame 123, allowing the sliding bolt 122 to be inserted. When the sliding bolt 122 is sufficiently inserted, the catch elements 129 expand outward into a slot 125A provided in the upper frame 123. The slot 125A is configured such as to prevent removal of the sliding bolt 122 without damaging the catch elements 129.

To remove the sliding bolt 122, a blade or diagonal pliers may be used to cut through the catch elements or hooks 129, so that the sliding bolt 122 can be removed from the secured position. In this case, the sliding bolt 122 can only be used once, i.e., it is a disposable article. A cutting line T is shown by way of example in FIG. 5A. The corresponding catch element or the hooks 129 can be cut through along the cutting line T. If all catch elements or hooks 129 have been removed, the sliding bolt 122 can be removed from the secured position.

Figure 6A:
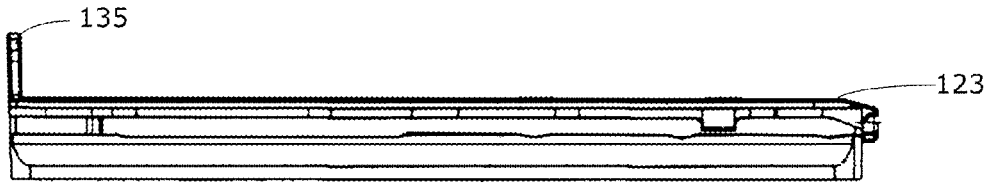
FIG. 6A is a side view of an upper frame.
Figure 6B:
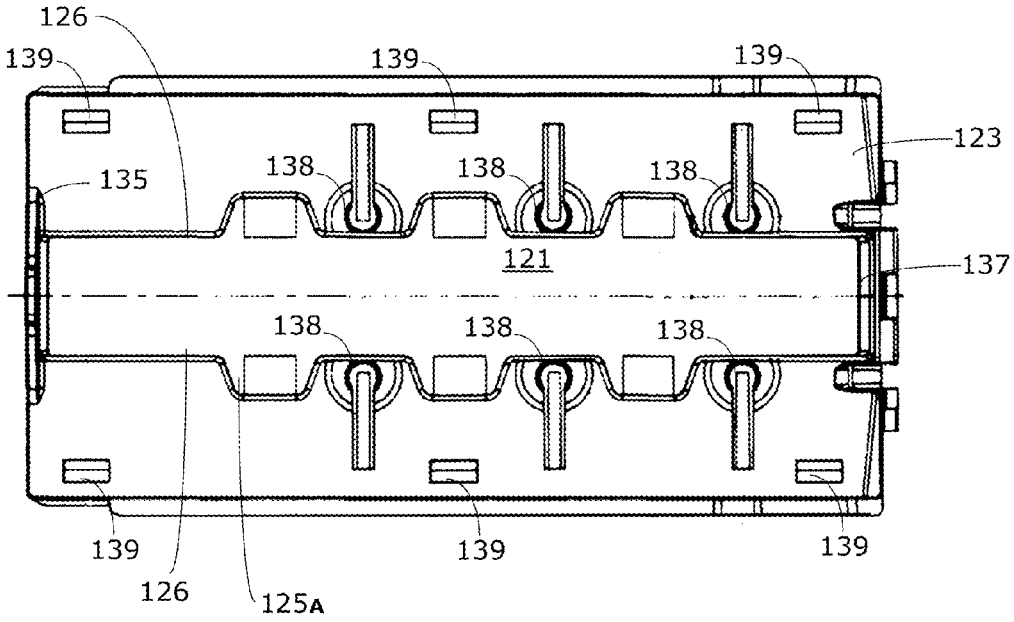
FIG. 6B is a top view of the upper frame of FIG. 6A.

As previously noted, the frame 120 comprises a lower frame 124 and an upper frame 123. FIGS. 6A and 6B show an exemplary embodiment of an upper frame 123. The dimensions of the upper frame 123 correspond approximately to the dimensions of the lower frame 124 in area (FIG. 6B). The upper frame 123 has a device-side end (shown generally on the right side in FIG. 6A) and a door-side end (shown generally on the left side in FIG. 6A). This reference is explained from a use of the upper frame 123. When the frame 120 is seated in a cash box 201 or a safe 200, the device-side end is seated furthest into the interior of the cash box 201 or the safe 200. In contrast, the door-side end is seated in the area of the door opening (see the door 204 in FIG. 1, for example). The handling mechanism 205 is seated above the upper frame 123.

In the embodiment shown, the upper frame 123 has a handle plate or a handle groove 135 on the door-side end. The upper frame 123 encloses the banknote opening 121, as shown in FIG. 6B. Guides 126 are provided along the long edges of the banknote opening 121 on the upper frame 123, which allow the sliding bolt 122 to be inserted from the left (i.e., from the door-side end) to the right into the frame 120. As shown, a support surface or receptacle bay 137 for an end tab 136 of the sliding bolt 122 is provided on the right end (on the device-side end).

Multiple spring-loaded balls 138, e.g. six in the shown embodiment, may be provided on the top side of the upper frame 123 to produce a formfitting (catch) connection with the handling mechanism 205. The handling mechanism 205 has recesses 205*a* in this case, which the balls 138 engage. Other snap or spring mechanisms may also be provided, which are designed so that the frame 120 engages in the cash box 201 or the safe 200. It is beneficial that a precisely defined position is maintained, so that the handling mechanism 205 can readily deliver the banknotes 1 through the frame 120 into the banknote bag 130.

Lugs or hooks can be provided on the bottom side of the upper frame 123, which are designed so they fixedly engage in the clamping areas 127 of the lower frame 124, in order to fixedly connect the upper frame 123 to the lower frame 124. These lugs or hooks are not shown in FIG. 6A and FIG. 6B, since they are generally located on the bottom side (not visible). However, access openings 139 may be seen, which allow the fixed connection of the upper frame 123 to the lower frame 124 to be disengaged using a tool (e.g., using a slotted screwdriver).

Figure 7A:
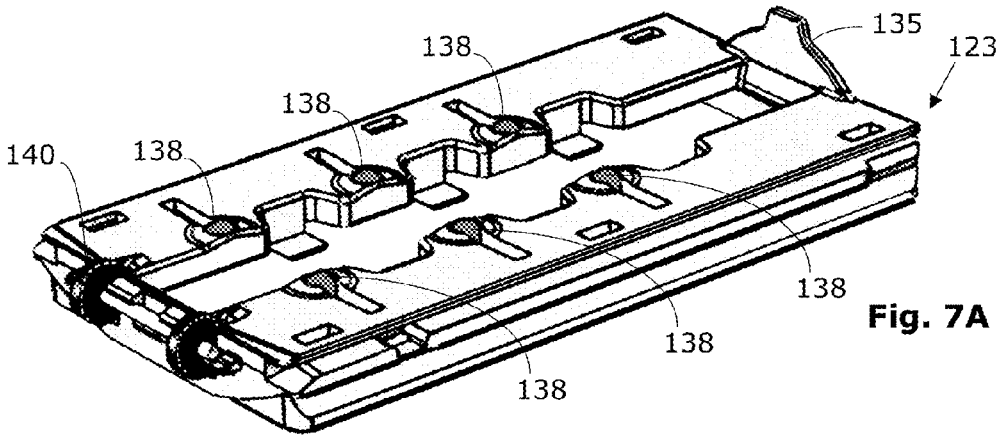
FIG. 7A is a perspective view of the upper frame of FIG. 6A.
Figure 7B:
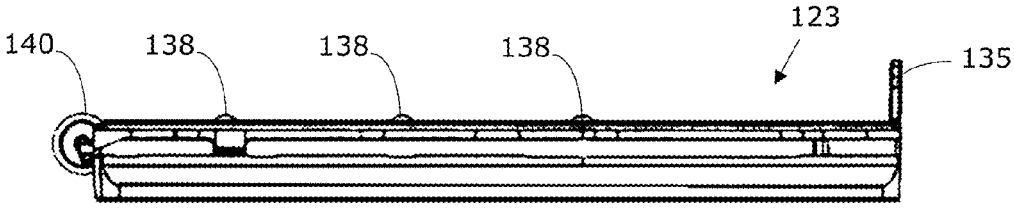
FIG. 7B is a side view of the upper frame of the opposite side shown in FIG. 6A.
Figure 7C:
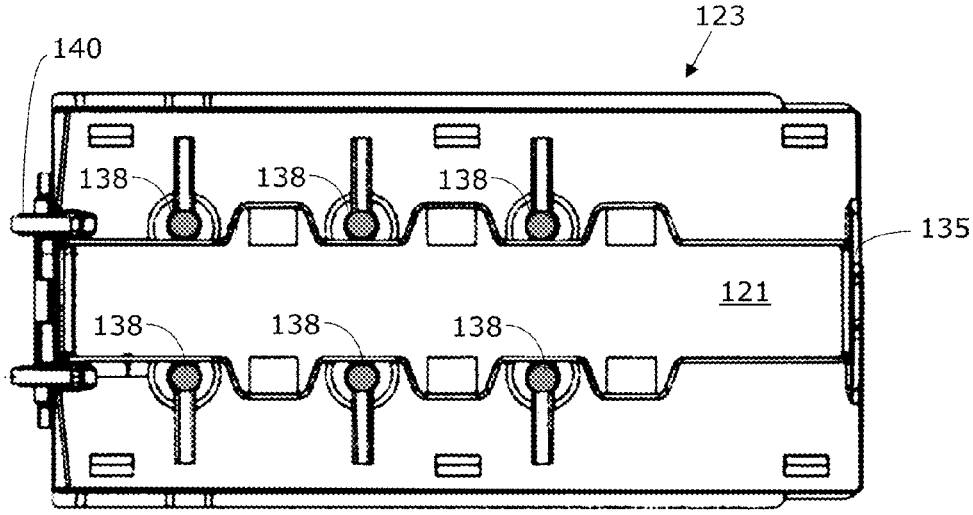

Further details of a combined or assembled frame 123 are shown in FIG. 7A-7C, with the sliding bolt 122 having not yet been inserted, which means that the banknote bag 130 would be accessible through the banknote opening 121. The balls 138 are shown in gray in FIG. 7A-7C, for visual emphasis.

Rollers or wheels 140 can be optionally provided on the device-side end of the frame 123, which allow a clean intake of the banknotes 1. They may be seated in the area of the handling mechanism 205.

Figure 8A:
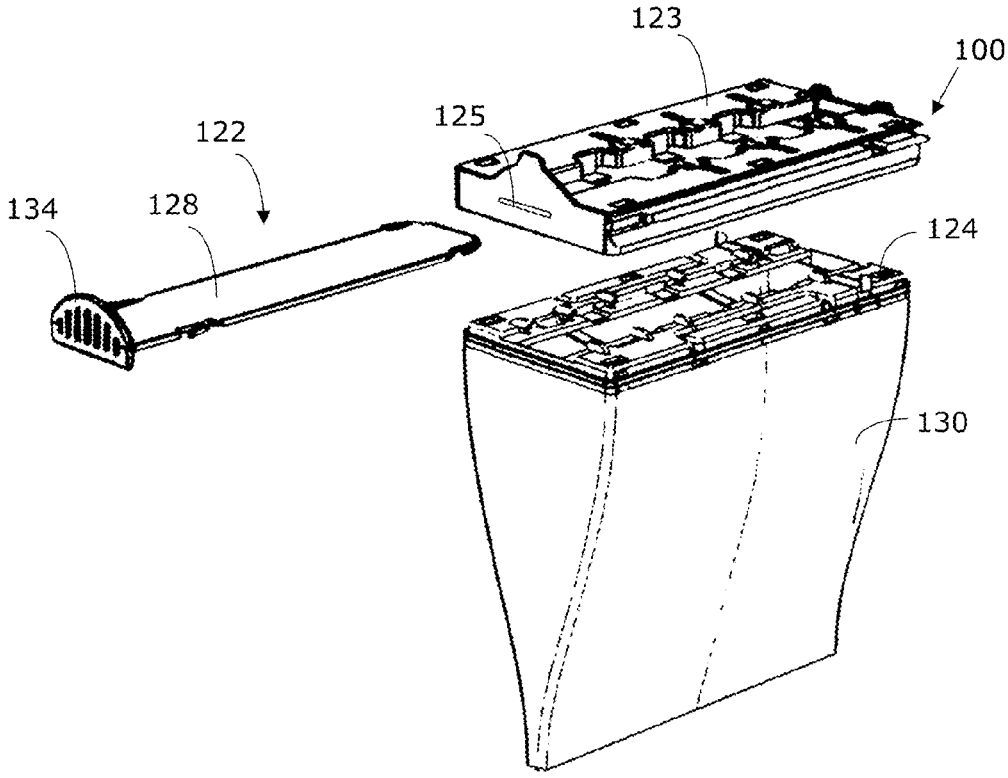
FIG. 8A is an exploded view of a device.
Figure 8B:
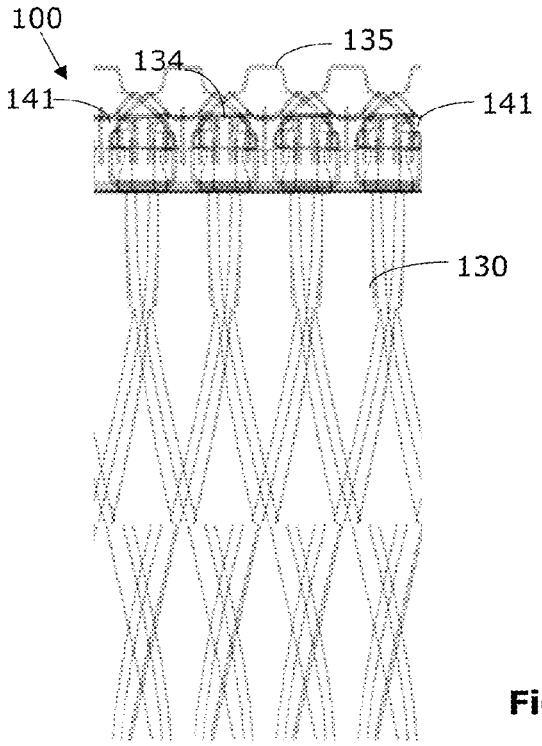
FIG. 8B is an enlarged partial side view of the device of FIG. 8A.
Figure 9:
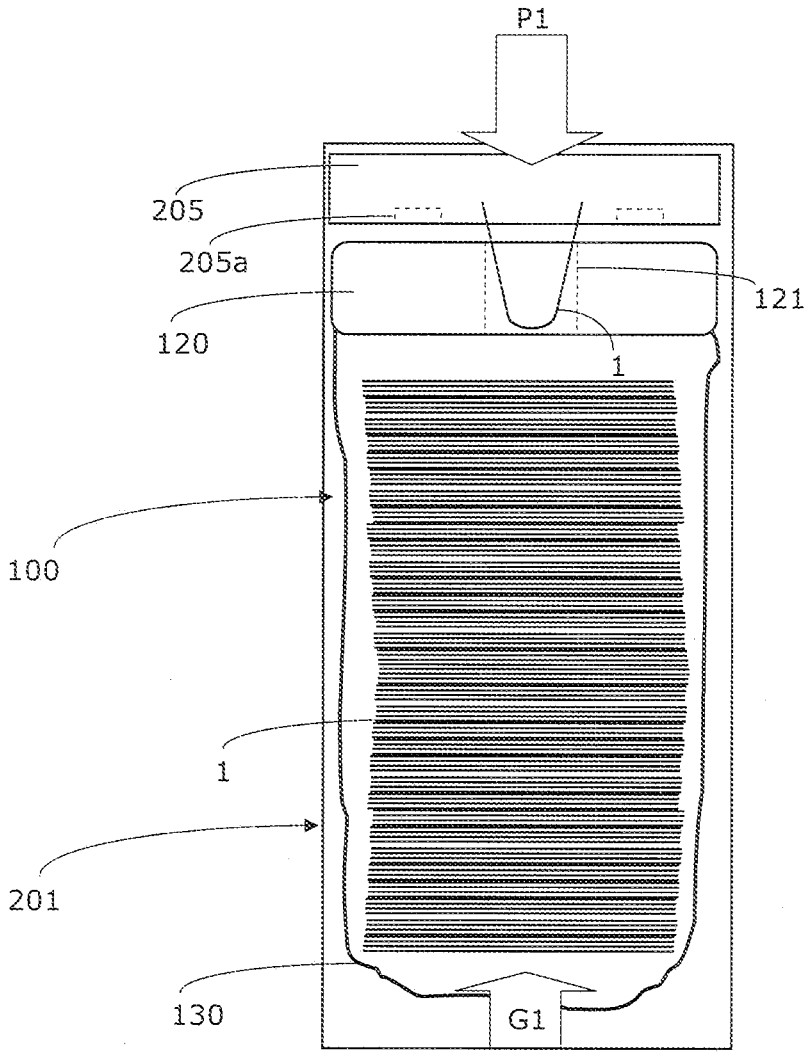
FIG. 9 is a schematic view of a cash box similar to the cash box of FIG. 2 where the handling mechanism has recesses.

FIG. 8A is an exploded view showing various elements of the device 100. As shown, the banknote bag 130 is already fixedly connected to the lower frame 124 and the rubber ring 131 for the banknote bundle is installed (see, e.g., FIG. 4C). For assembling the device 100, the upper frame 123 is then fastened on the lower frame 124, which is performed, for example, by engaging or hooking lugs or hooks on the upper frame 123 in the clamping areas 127 of the lower frame 124. The sliding bolt 122 is then inserted and brought into a secured position. In the secured position, which is shown in FIG. 8B, the sliding plate 128 of the sliding bolt 122 completely covers the banknote opening 121. The sliding bolt 122 is fixedly locked in the secured position and connects both frames 123, 124 to one another.

The slot 125 may be provided on the upper frame 123, on the lower frame 124, or can be defined by both frame parts 123, 124 together.

Elements 141, which are designed for inserting or placing the frame 120 in the cash box 201 or the safe 200, are may be provided on the frame 120 (see FIG. 8B). Elements 141, which are used as guide rails, are shown in FIG. 8B.

The removal of a filled banknote bag 130 is performed as shown by way of example. The cash box 201 or the safe 200 is transferred into a suitable mode (e.g., by inputting a PIN code or using a key). The door 204 is then opened and a new (undestroyed) sliding bolt 122 is inserted through the slot 125 into the frame 120. When the sliding bolt 122 reaches the secured position, the banknote opening 121 is completely covered and secured. Either the sliding bolt 122 directly unlocks the frame 120, including the banknote bag 130 upon reaching the secured position, or the sliding bolt 122 allows it to be unlocked. The actual unlocking can then be performed by, for example, using a further handling step (e.g., by the further input of a (different) PIN code or the use of a key). When the frame 120, including banknote bag 130, has been unlocked, the device 100 can be removed completely from the cash box 201 or the safe 200.

The device 100 can then be transported away in a special secured transport case or trolley, for example. The number of banknotes 1 located in the device 100 is stored, for example, in a memory of the cash box 201 or the safe 200. A mechanical manipulation of the banknote bag 130 or the frame 120 is recognizable. In addition, by recounting the banknotes 1, it is possible to recognize whether there is a shortfall in relation to the stored value.

In order to be able to remove the banknotes 1 at a secured location, e.g., in the cash office of a banking institute, the banknote bag 130 is cut open. The sliding bolt 122 is then destroyed and removed by the use of a suitable tool (e.g., a blade or diagonal pliers). A further suitable tool is used to separate the upper frame 123 from the lower frame 124. The remainder of the banknote bag 130 can then be removed.

The device 100 is then prepared for further use. by attaching a new banknote bag 130, as described, and connecting. the upper frame 123 to the lower frame 124.

Accordingly, the banknote bag 130 and the sliding bolt 122 are the only disposable parts which have a one time use. All other parts can be used multiple times, which is significantly more cost-effective and better for the environment than in the case of previous solutions, in which all parts are only capable of a single use.

As should be recognized by those of ordinary skill in the pertinent art based on the teachings herein, numerous changes and modifications may be made to the above-described and other embodiments of the present invention without departing from its scope as defined in the appended claims. Accordingly, this detailed description of embodiments is to be taken in an illustrative, as opposed to a limiting, sense.

What is claimed is:

1. A device for receiving at least one banknote, comprising:

a frame with an upper frame and a lower frame connectable to and separable from each other, the frame including a banknote opening extending through the upper frame and the lower frame when the upper frame is connected to the lower frame, a banknote bag having a bag opening and connected to the frame at the bag opening such that at least one banknote is introducible into the banknote bag through the banknote opening and the bag opening; and a stable sliding bolt;

wherein:

the frame comprises a guide for inserting the sliding bolt configured so that in an inserted state therein the sliding bolt is locked to the frame and completely blocks the banknote opening of the upper and lower frames;

the lower frame includes clamping areas;

the upper frame includes lugs or hooks; and the clamping areas are configured so that the lugs or hooks of the upper frame hook or engage in the clamping areas of the lower frame and fixedly connect the lower frame to the upper frame.

2. A device as defined in claim 1, wherein the frame includes a mechanical interface for insertion into a cash box configured so that banknotes are introducible from the cash box through the banknote opening of the upper and lower frames into the banknote bag.

3. A device as defined in claim 1, wherein the lower frame comprises means for fastening on the lower frame a rubber strip or a rubber ring configured to receive banknotes in the banknote bag.

4. A device as defined in claim 2, wherein the lower frame comprises means for fastening on the lower frame a rubber strip or a rubber ring configured to receive the banknotes in the banknote bag.

5. A device as defined in claim 1, wherein the banknote bag is a plastic bag or a fabric bag.

6. A device as defined in claim 2, wherein the banknote bag is a plastic bag or a fabric bag.

7. A device as defined in claim 1, wherein the banknote bag comprises at least one of eyes, hooks, an elastic band, and a rubber strip for connection to the lower frame.

8. A device as defined in claim 2, wherein the banknote bag comprises at least one of eyes, hooks, an elastic band, and a rubber strip for connection to the lower frame.

9. A device as defined in claim 1, wherein the sliding bolt includes catch elements or hooks configured for providing a fixed, non-removable hooking of the sliding bolt in a locked position.

10. A device as defined in claim 2, wherein the sliding bolt includes catch elements or hooks configured for providing a fixed, non-removable hooking of the sliding bolt in a locked position.

11. A device as defined in claim 1, wherein the upper frame includes spring-loaded balls configured to interact with recesses of a cash box or a safe when the device is placed or inserted therein.

12. A device as defined in claim 2, wherein the upper frame includes spring-loaded balls configured to interact with recesses of a cash box or a safe when the device is placed or inserted therein.

13. A device as defined in claim 1, wherein the sliding bolt and the banknote bag are adapted for a single use and the upper frame and the lower frame are adapted for multiple uses.

14. A device as defined in claim 2, wherein the sliding bolt and the banknote bag are adapted for a single use, and the upper frame and the lower frame are adapted for multiple uses.

15. A security system, comprising:

a safe or a cash box; and at least one device for receiving at least one banknote comprising:

a frame including a banknote opening, a banknote bag having a bag opening and connected to the frame at the bag opening such that the at least one banknote is introducible into the banknote bag through the banknote opening and the bag opening; and a stable sliding bolt;

wherein the frame comprises an upper frame and a lower frame connectable to and separable from each other, the banknote opening extending through the upper frame and the lower frame when the upper frame is connected to the lower frame by lugs or hooks of the upper frame engaging into clamping areas of the lower frame, and a guide for inserting the sliding bolt configured so that in an inserted state therein the sliding bolt is locked to the frame and completely blocks the banknote opening of the upper and lower frames.

16. A security system as defined in claim 15, wherein the frame includes a mechanical interface for insertion into a cash box configured so that banknotes are introducible from the cash box through the banknote opening of the upper and lower frames into the banknote bag.

17. A security system as defined in claim 15, wherein the safe or the cash box includes a pressure system having a gas cartridge to discharge a liquid if the safe or the cash box is manipulated.

18. A security system as defined in claim 16, wherein the safe or the cash box includes a pressure system having a gas cartridge to discharge a liquid if the safe or the cash box is manipulated.

19. A method for preparing a device configured to receive banknotes, comprising:

attaching a banknote bag having a bag opening to a lower frame having a banknote opening so that the bag opening of the banknote bag is located below the banknote opening;

fixedly connecting an upper frame having a banknote opening with the lower frame by engaging lugs or hooks of the upper frame into clamping areas of the lower frame so that the banknote opening of the upper frame and the banknote opening of the lower frame allow access to the bag opening; and placing or inserting a device comprised of the upper frame, the lower frame, and the banknote bag into a cash box or a safe so that the top side of the upper frame forms a connection with a handling mechanism of the cash box or the safe.

20. A method as defined in claim 19, wherein after banknotes are introduced into the banknote bag, removing the device by:

inserting a stable sliding bolt into the device and transferring the sliding bolt into a secured position in which the sliding bolt is fixedly connected to the device and the banknote opening is completely blocked; and removing the device from the cash box or from the safe.

21. A method as defined in claim 20, further comprising:

destroying the banknote bag to remove the banknotes therefrom; and removing the sliding bolt by destroying catch elements or hooks of the sliding bolt.

* * * * *